United States Patent [19]

Beggs

[11] 4,287,509

[45] Sep. 1, 1981

[54] SOUND AND LIGHT SIGNALING SYSTEM

[76] Inventor: Daniel H. Beggs, 191 Dickinson St., Rochester, N.Y. 14621

[21] Appl. No.: 23,538

[22] Filed: Mar. 26, 1979

[51] Int. Cl.[3] ..... G08B 7/00

[52] U.S. Cl. ..... 340/326; 340/371

[58] Field of Search ..... 340/326, 371

[56] References Cited

U.S. PATENT DOCUMENTS

| | | | |
|---|---|---|---|
| 3,916,404 | 10/1975 | Gouge | 340/371 |
| 4,101,880 | 7/1978 | Haus | 340/371 X |
| 4,148,023 | 4/1979 | Elkin | 340/326 |

FOREIGN PATENT DOCUMENTS

| | | | |
|---|---|---|---|
| 2216266 | 10/1973 | Fed. Rep. of Germany | 340/371 |

*Primary Examiner*—Donald J. Yusko

*Attorney, Agent, or Firm*—Douglas Ian Hague

[57] ABSTRACT

An alarm system provides both audible and visual signaling of emergency conditions. The audible signaling component of the system comprises a well-known audible fire alarm including an electric horn, bell or siren and an activating switch for applying enabling potential to operate the audible alarm in response to occurrence of particular emergency events. The visual signaling component of the system comprises a sensor for sensing the application of a current-voltage to the terminals of the audible device, at least one high intensity lamp of the type producing illumination of such intensity and duration so as to excite the human optic senses, a power supply and a trigger circuit. The trigger circuit is connected to the lamp, the power supply and the sensor and applies enabling potential to the lamp from the power supply in response to the receipt of a signal from the sensor.

4 Claims, 1 Drawing Figure

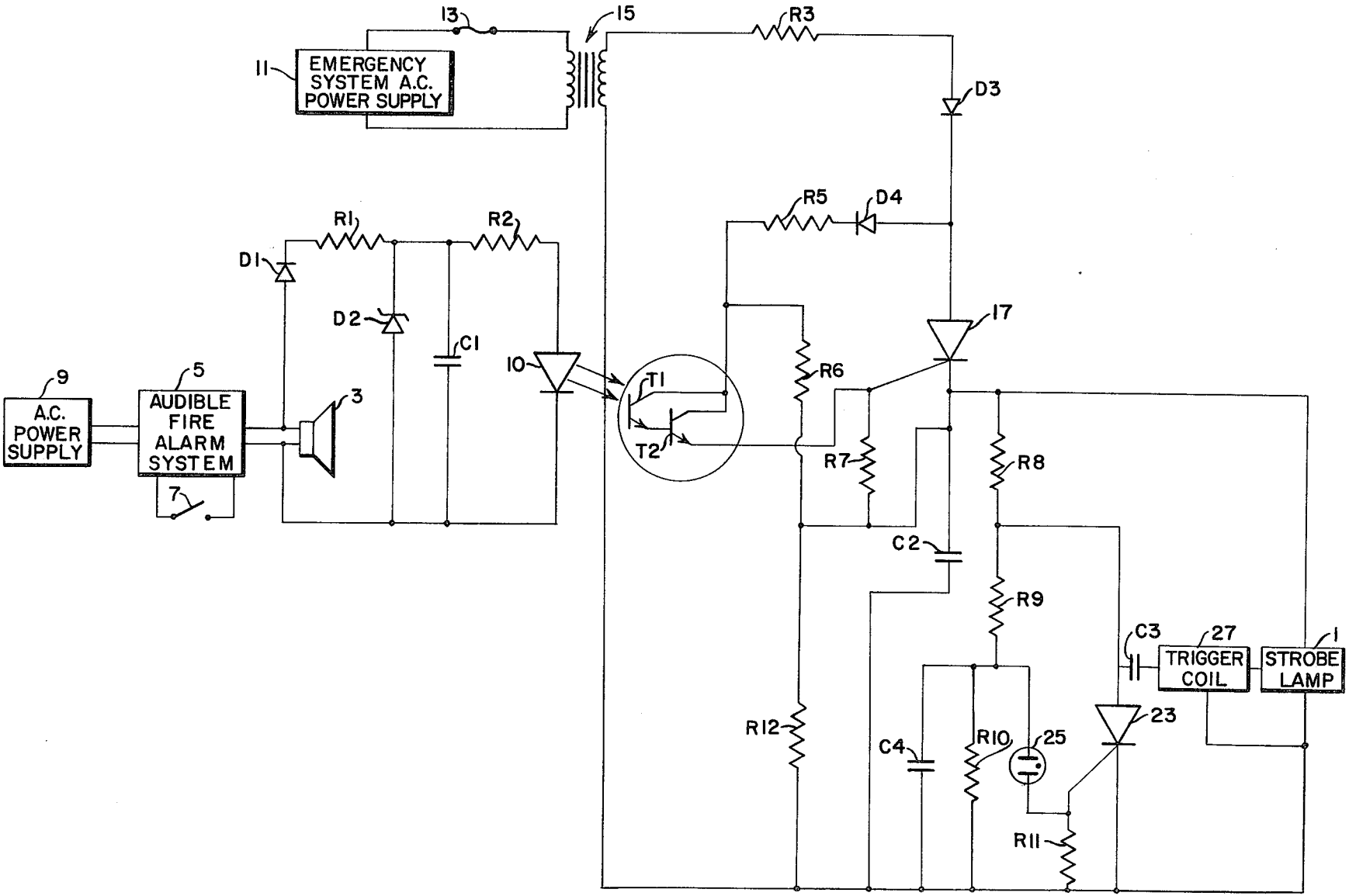
STROBE LAMP
1
TRIGGER COIL
27
C3
23
25
R11
R10
R8
R9
17
D3
C2
C4
D4
R7
R6
R5
R3
R12
T1
T2
15
10
R2
C1
13
EMERGENCY SYSTEM A.C. POWER SUPPLY
11
R1
D2
3
D1
AUDIBLE FIRE ALARM SYSTEM
5
7
A.C. POWER SUPPLY
9

SOUND AND LIGHT SIGNALING SYSTEM

BACKGROUND OF THE INVENTION

1. Field of the Invention

The present invention relates to signaling systems and more particularly, to signaling systems which provide both audible and visual signaling of particular events.

2. Description of the Prior Art

Most alarm systems currently in use are designed for normal hearing persons and provide audible signaling of emergency conditions such as fire, smoke or other potential dangers. Alarm systems have also been developed for hearing-impaired persons which provide visual signaling of emergency conditions, for example by a repeatedly operated, high intensity strobe lamp. Newly promulgated safety regulations in most jurisdictions require public buildings and other areas which are likely to be occupied by both normal hearing and hearing-impaired persons to be equipped with alarm systems suitable for all occupants. Alarm systems are known which provide both audible and visual signaling of emergency conditions. These dual signaling systems are suitable for new building construction or original installations. However, when the alarm system of an existing building, typically providing only audible signaling, must be upgraded to provide both audible and visual signaling, the present state of the art requires, at the very least, removal of the audible alarm system and replacement with the dual signaling system. Installation of some dual signaling systems also require re-wiring back to the main panel and major changes in the panel itself. This is an obvious economic disadvantage.

SUMMARY OF THE INVENTION

It is therefore an object of the present invention to provide an improved emergency signaling system which provides both audible and visual signaling of events.

It is another object of the invention to provide a simple, cost effective visual signaling system which can be readily added onto an audible signaling system previously installed in an existing building.

These and other objects and advantages are achieved in accordance with the present invention by providing apparatus containing an audible signaling system and a parasitic visual signaling system. The audible signaling system includes sound producing means such as an electric fire alarm horn, disposed in the areas of a building adapted to be occupied by normal hearing persons, a source of power connected to the fire alarm horn and an actuating switch which enables the power source to operate the horn. The visual signaling system includes one or more high intensity lamps disposed in the areas of the building adapted to be occupied by hearing-impaired persons, a sensor for sensing the the application of power to the fire alarm horn and for providing an output signal in response thereto and a trigger circuit connected to (1) a source of power, such as the emergency power source which supplies the building's exit lights, (2) the high intensity lamps and (3) the sensor for enabling the lamps in response to the receipt of an output signal from the sensor.

One advantage of the present invention is that two independent signaling systems are not required since the visual signaling system is parasitic. That is to say the trigger signal for enabling the application of power to the lamps of the visual signaling system is derived from the audible signaling system. This advantage is particularly beneficial when the apparatus of the present invention is installed in an existing building already equipped with an audible fire alarm system. In this application, the power for the visual signaling system can be obtained from the building's existing exit light circuit or other emergency circuit. By locating the high intensity lamps near either a fire alarm horn or an exit light only a minimum amount of new conduit must be run and all that must be known for a given installation is the voltage of the exit light circuit and the voltage of the fire alarm circuit.

The invention, its operation and its objects and advantages will become more apparent by referring to the accompanying drawing and to the ensuing detailed description of the preferred embodiment.

BRIEF DESCRIPTION OF THE DRAWING

In the detailed description of the preferred embodiment of the invention presented below, reference is made to the accompanying drawing in which there is shown a schematic diagram of a circuit constructed in accordance with the teachings of this invention for producing both audible and visual signals of particular events.

DETAILED DESCRIPTION OF THE PREFERRED EMBODIMENT

Referring now to the drawing, reference numeral 1 designates a strobe lamp which may be installed in each room of a building where the attention of deaf or hearing-impaired persons is desired. This strobe lamp may be a Xenon lamp of the type used in photo-flash equipment. The lamp when flashed constitutes an intense source of illumination which has been found to excite the optic nerves so as to arouse the attention of persons in the vicinity of the illumination.

Reference numeral 3 designates an electric horn which forms part of an audible fire alarm system 5. The audible fire alarm system 5 which may be either of the A.C. or D.C. type can be selected from those known in the art and hence its construction and operation will not be described in detail.

When a switch 7 is closed, for example in response to the receipt of a signal from either a temperature sensor or smoke detector (not shown), a power supply 9 (shown in the drawing as an A.C. power supply, however a D.C. power supply would be used if a D.C. fire alarm system 5 were selected) is enabled to operate the horn 3 which produces a loud audible sound sufficient to arouse the attention of normal hearing persons. Activating the horn 3 also enables the application of electrical power from the fire alarm system to the circuit comprising diode $D_1$, resistors $R_1$ and $R_2$, Zener diode $D_2$, capacitor $C_1$ and light emitting diode (LED) 10. Diode $D_1$ rectifies the AC voltage supplied by the power supply 9. Capacitor $C_1$ smooths the D.C. pulses provided by the diode $D_1$. The Zener diode $D_2$ and the resistors $R_1$ and $R_2$ limit the amplitude of the D.C. voltage pulses applied to the LED 10 to the levels required for efficient light production.

Power to operate the strobe lamp 1 is derived from an AC power supply 11 which supplies AC voltage through a slow-blow fuse 13 to the primary coil of a step-up transformer 15. In a preferred embodiment of the invention, the power supply 9 and the power supply 11 are a common emergency power supply, with the exit light circuit of such emergency power supply providing the power to operate the strobelamp 1 and the fire alarm circuit of the emergency power supply providing power to activate the LED 10 to produce the firing signal. The output of the transformer 15 is fed through a surge suppression resistor $R_3$, which limits the in-rush of voltage to a capacitor $C_2$, after the firing of the strobe lamp 1 as described in detail hereinbelow. A diode $D_3$ supplies rectified D.C. voltage pulses to the anode of a normally inactive silicon controlled rectifier (SCR) 17 and through diode $D_4$ to the resistors $R_5$, $R_6$ and $R_{12}$. The voltage fed through the resistor $R_6$ is supplied to a capacitor $C_2$ to maintain a predetermined charge level thereon during the long inactive periods of the SCR 17. The magnitude of the voltage supplied by the resistor $R_6$ to the capacitor $C_2$ is dependent on the capacitor's leakage rate. Resistors $R_5$, $R_6$ and $R_{12}$ form a voltage divider network which limits the voltage across phototransistors $T_1$ and $T_2$, arranged in the darlington connection, so as not to exceed the transistors breakdown voltage when such transistors are in the nonconductive state. The voltage divider network also functions to provide the necessary gate current through transistor $T_2$ to an SCR 17 when the transistor $T_2$ is in the conductive state (saturation).

The phototransistors $T_1$ and $T_2$ together with the LED 10 form an optoelectronic isolator also known as a photon coupled isolator. When the LED 10 emits light, the phototransistors $T_1$ and $T_2$ become forward biased and turn on. The emitter current of the phototransistor $T_2$ is applied to biasing resistor $R_7$ and the gate electrode of the SCR 17 turning the SCR on. When the SCR 17 turns on, each positive half cycle of the voltage waveform supplied by the transformer 15 and transmitted by the diode $D_3$ is applied to the capacitor $C_2$. The capacitor $C_2$ is rapidly charged to its maximum potential and applies a voltage through a voltage divider formed by resistors $R_8$ and $R_9$ to the anode of an SCR 23, and to two capacitors $C_3$ and $C_4$, respectively. The capacitor $C_4$ together with a resistor $R_{10}$ and a neon lamp 25 form a relaxation oscillator. When the capacitor $C_4$ charges to the ignition point of neon lamp 25, the lamp 25 is turned on and applies current to biasing resistor $R_{11}$ and the gate electrode of the SCR 23 turning the SCR on. When SCR 23 turns on, the capacitor $C_3$ discharges through the trigger coil 27 of the strobe lamp 1 and fires the latter. When the trigger coil 27 fires the strobe lamp 1, the SCR 23 switches back to the nonconducting state and the capacitor $C_2$ begins recharging in preparation for the next firing cycle. The strobe lamp 1 will operate repeatedly at a time interval determined by the relaxation oscillator as long as power is supplied to the horn 3 of the audible fire alarm system 5.

From the foregoing description it will become apparent that there has been provided an improved signaling system for warning both normal hearing and hearing-impaired persons of emergency conditions which is especially suitable for installation in a building having an existing audible signaling system.

While the invention has been described in detail with reference to a preferred embodiment thereof it will be understood that variations and modifications can be effected within the spirit and scope of the invention. For example, if desired a reed relay could be substituted for the light emitting diode and photosensitive transistors and a random signal generator could be substituted for the relaxation oscillator. The visual signaling component of the system could include a thermistor which turns the system off when a predetermined internal unit temperature is reached. Further still, a D.C. battery could be used as the emergency system power supply with appropriate modifications to the charging circuit.

I claim:

1. In a signaling system of the type adapted to produce audible signals in the event of emergency conditions, the improvement comprising:

(a) an opto-electronic isolator for sensing at one location the application of power to the audible signaling system and for providing an output signal in response thereto at a second location physically separated from the audible signaling system;

(b) at least one high intensity lamp of the type producing illumination of such intensity and duration so as to excite the human optic senses;

(c) a source of potential; and (d) a trigger circuit connected to said lamp, said source of potential and said opto-electronic isolator, said trigger circuit applying enabling potential to said lamp from said source of potential in response to the receipt of an output signal from said opto-electronic isolator.

2. The signaling system of claim 1 wherein said lamp comprises a strobe lamp connected to said opto-electronic isolator and adapted to be gated into conducting upon receipt of the output signal from said opto-electronic isolator.

3. The signaling system of claim 1 wherein said trigger circuit includes a silicon controlled rectifier.

4. The apparatus according to claim 3 wherein said trigger circuit further includes a relaxation oscillator and a trigger coil connected between said silicon controlled rectifier and said lamp means.

* * * * *